US009476279B2

(12) United States Patent
Bailey et al.

(10) Patent No.: US 9,476,279 B2
(45) Date of Patent: Oct. 25, 2016

(54) BELL NIPPLE ASSEMBLY APPARATUS AND METHODS

(71) Applicant: Nabors Drilling International Limited, Hamilton (BM)

(72) Inventors: Sean M. Bailey, Willis, TX (US); Padira Reddy, Richmond, TX (US)

(73) Assignee: Nabors Drilling International Limited, Hamilton (BM)

( * ) Notice: Subject to any disclaimer, the term of this patent is extended or adjusted under 35 U.S.C. 154(b) by 610 days.

(21) Appl. No.: 13/942,500

(22) Filed: Jul. 15, 2013

(65) Prior Publication Data

US 2015/0013994 A1 Jan. 15, 2015

(51) Int. Cl.
*E21B 33/038* (2006.01)
*E21B 21/00* (2006.01)
*E21B 21/01* (2006.01)

(52) U.S. Cl.
CPC ..... *E21B 33/038* (2013.01); *E21B 21/00* (2013.01); *E21B 21/01* (2013.01)

(58) Field of Classification Search
CPC ..... E21B 33/038; E21B 33/076; E21B 21/01
See application file for complete search history.

(56) References Cited

U.S. PATENT DOCUMENTS 3,163,239 A * 12/1964 De Vries Douwe .... E21B 7/128 175/7
4,597,447 A * 7/1986 Roche ..... E21B 21/106 166/347
4,836,289 A 6/1989 Young
4,971,148 A * 11/1990 Roche ..... E21B 33/03 166/82.1
6,367,554 B1 * 4/2002 Theiss ..... E21B 17/01 166/365
7,258,171 B2 8/2007 Bourgoyne et al.
7,487,837 B2 2/2009 Bailey et al.
7,699,109 B2 4/2010 May et al.
8,322,432 B2 12/2012 Bailey et al.
8,347,983 B2 1/2013 Hoyer et al.
8,408,297 B2 4/2013 Bailey et al.
2011/0168392 A1 7/2011 Bailey et al.
2012/0090893 A1 4/2012 Leuchtenberg
2012/0091705 A1 * 4/2012 Reinas ..... E21B 17/07 285/223
2013/0009366 A1 1/2013 Hannegan et al.
2013/0206418 A1 * 8/2013 Pettersen ..... E21B 19/004 166/336

OTHER PUBLICATIONS

Pettersen et al. WO 2012/016947. Method and System for Performing Well Operations. Published Feb. 9, 2012.*

* cited by examiner

*Primary Examiner* — David Andrews
*Assistant Examiner* — Tara Schimpf
(74) *Attorney, Agent, or Firm* — Haynes & Boone, LLP

(57) ABSTRACT

An apparatus including a bell nipple assembly defining a first internal passage that includes two sections forming first and second internal passages that may be aligned by a flexible connector disposed between first and second flanges in one of the sections to at least partially adjust for an offset amount caused by longitudinal axis misalignment of the other section. Methods of adjusting for longitudinal axis offset between two misaligned components, such as of a bell nipple zone, are also encompassed.

22 Claims, 5 Drawing Sheets

BELL NIPPLE ASSEMBLY APPARATUS AND METHODS

TECHNICAL FIELD

The disclosure is directed to an apparatus including a bell nipple containment system, along with methods of using such bell nipple containment system.

BACKGROUND OF THE DISCLOSURE

While drilling, drilling fluids or drilling mud may be delivered to the drill string through a washpipe system. From a top drive and associated wash pipe, the fluids are transported and supplied to the drill string. The drill string generally extends through an opening in a rig floor, through a bell nipple assembly and through a blow out preventer before entering into a wellbore.

The bell nipple assembly and blow out preventer are often coupled together below the rig floor. The bell nipple assembly, which funnels drilling tools into the blow out preventer or downhole, is generally located above the blow out preventer. The blow out preventer is attached to an annular near a wellhead. When the annular is cut at an angle, a longitudinal axis of the blow out preventer that is attached to the annular is often not coaxial with a longitudinal axis of the wellhead, which can result in an offset between longitudinal axes. Additionally, the blow out preventer may be replaced during a pause in drilling, or the bell nipple assembly may be moved to a drilling location that has a blow out preventer with a different connection height or connection diameter. This can require the removal or exchange of the bell nipple assembly for another bell nipple assembly that is compatible with the new blow out preventer. Moreover, drilling fluids often escape at a location between the bell nipple assembly and the rig floor.

The present disclosure is directed to apparatuses and methods to address these problems. Thus, the present disclosure provides a unique structural arrangement adjustable to different heights to couple the blow out preventer to the rig floor, while adjusting offset between the longitudinal axes of the blow out preventer and the wellbore and minimizing or preventing the drilling fluid from spilling out the bell nipple assembly or any gap between it and the rig floor.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
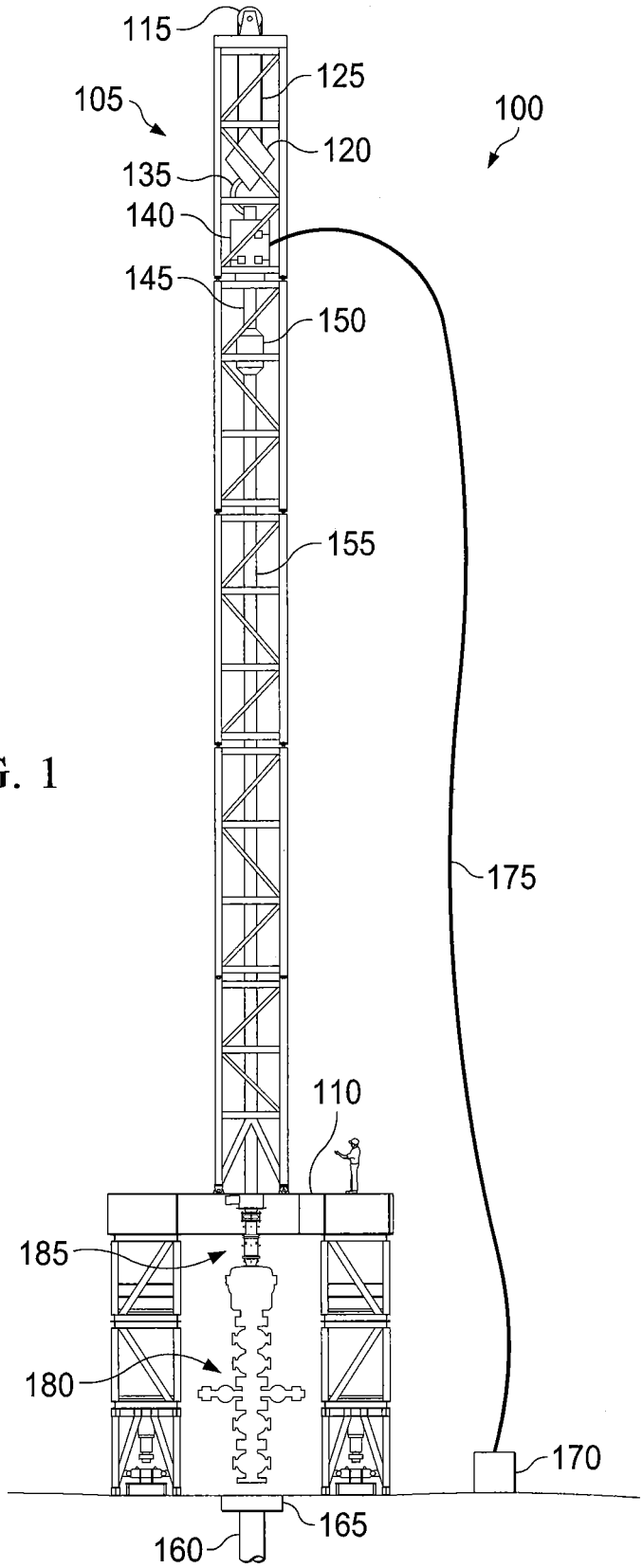
FIG. 1 is a schematic of an apparatus including a bell nipple assembly according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure is directed to apparatuses and methods having a unique structural arrangement that adjusts for any misalignment between a blow out preventer and the drilling floor, while providing a positive seal between the blow out preventer and the drilling floor, to minimize or prevent leakage and spills of drilling fluids.

Referring to FIG. 1, illustrated is a schematic view of an apparatus 100 demonstrating one or more aspects of the present disclosure. The apparatus 100 is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure.

The apparatus 100 includes a mast 105 supporting lifting gear above a rig floor 110. The lifting gear includes a crown block 115 and a traveling block 120. The crown block 115 is coupled at or near the top of the mast 105, and the traveling block 120 hangs from the crown block 115 by a drilling line 125.

A hook 135 is attached to the bottom of the traveling block 120. A top drive 140 is suspended from the hook 135 as shown. In various embodiments, a quill 145 extending from the top drive 140 is attached to a saver sub 150, which is attached to a drill string 155 that can be suspended within a wellbore 160 having a wellhead 165. Alternatively, the quill 145, when present, may be attached to the drill string 155 directly (not shown).

One or more pumps 170 may deliver drilling fluid to the drill string 155 through a hose or other conduit 175, which may be fluidically and/or actually connected to, or pass through, the top drive 140. The drilling fluid moves down the drill string 155 and then up the wellbore 160. A blow out preventer 180 is shown connected to the wellhead 165 and attached to a bell nipple assembly 185.

Figure 2:
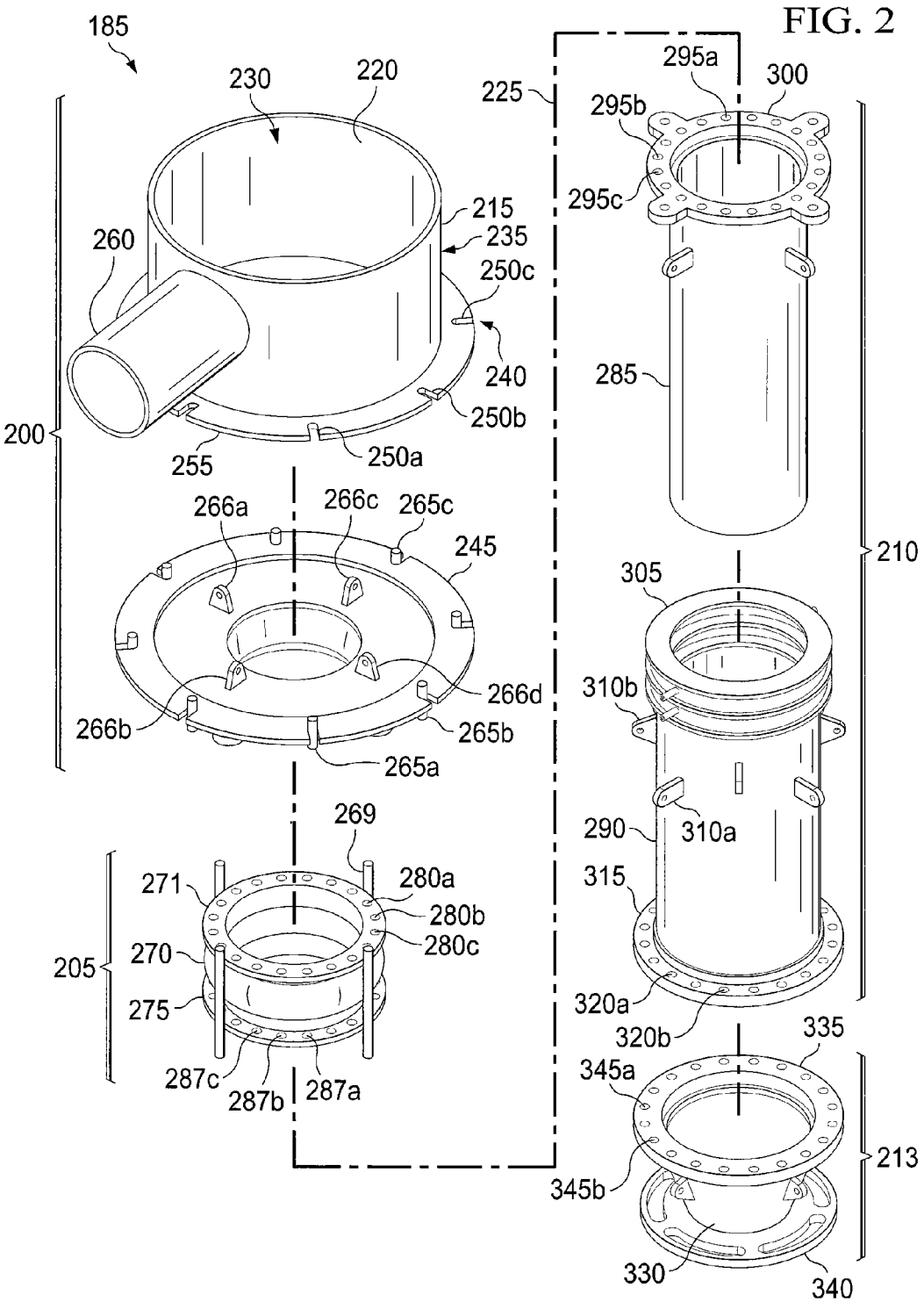
FIG. 2 is an exploded perspective view of the bell nipple assembly of FIG. 1 according to one or more aspects of the present disclosure.

FIG. 2 shows an exemplary embodiment of the bell nipple assembly 185 referenced in FIG. 1. In one embodiment, the bell nipple assembly 185 couples to the drilling floor 110 and the blow out preventer 180 (FIG. 1). For explanatory purposes, the bell nipple assembly 185 is divided into sections. Accordingly, as referenced in FIG. 2, the bell nipple assembly 185 includes a containment housing section 200, a flex joint section 205, a bell nipple section 210, and a mounting section 213. In one embodiment, a blow out preventer 180 (FIG. 1) is coupled to the mounting section 213, which is coupled to the bell nipple section 210, which is coupled to the flex joint section 205, which is coupled to the containment housing section 200, which is coupled to the drilling floor 110.

The following description references FIG. 2. In one embodiment, the containment housing section 200 includes a containment housing 215 forming a fluid flow passage 220 along an axis 225. An inlet 230 to the flow passage 220 is formed within the containment housing 215 and allows the drill string 155 (FIG. 1) to pass into and through the flow passage 220. In one embodiment, the containment housing 215 is generally cylindrical in shape and has an upper containment housing portion 235 forming an inner diameter and a lower containment housing portion 240 forming an outer diameter. In one embodiment, the inner diameter of the upper containment housing portion 235 is sized to accommodate a rotary table (not shown) located on or in the drilling floor 110 (FIG. 1). In one embodiment, the upper containment housing portion 235 is flush with a containment pan or rotary table (not shown). In one embodiment, a containment pan or drip pan is disposed above the containment housing 215. In one embodiment, the lower containment housing portion 240 is configured to couple to a containment housing flange 245 using at least a plurality of bores 250*a*, 250*b*, and 250*c* that are spaced along a lower flange 255 located on the lower containment housing portion 240. In one embodiment, a flowline 260 is fluidically connected to the containment housing 215, and in the exemplary embodiment shown in FIG. 2, extends radially from a side of the containment housing 215. In one embodiment, the flowline 260 allows for the drilling fluid to flow out of the containment housing 215. The containment housing flange 245 is generally circular in shape and includes an inner diameter and an outer diameter. The inner diameter of the containment housing flange 245 is sized to allow the drill string 155 to pass through the inner diameter. At least a plurality of bores 265*a*, 265*b*, and 265*c* that correspond to the plurality of bores 250*a*, 250*b*, and 250*c* are located near the outer diameter of the containment housing flange 245 to couple the containment housing flange 245 to the containment housing 215. However, the containment housing flange 245 may be coupled to the containment housing 215 using any of a variety of fasteners or fastening methods, such as bolts and screws, welds, pressure or snap fits, rivets, etc., or any combination thereof, available to those of ordinary skill in the art. In one embodiment, at least a plurality of padeyes 266*a*, 266*b*, 266*c*, and 266*d* are disposed between the inner diameter and the outer diameter of the containment housing flange 245. In one embodiment, a plurality of bores (not shown) are located on a locking plate 267 (shown in FIG. 3) located on a lower portion of the containment housing flange 245. Additionally and in one embodiment, locking bores such as locking bore 268, are disposed on the locking plate 267 and are configured to receive a locking bolt 269 (shown in FIG. 3).

In one embodiment, the flex joint section 205 includes a flex joint 270 disposed between a first surface 271 and a second surface 275 that are spaced along the axis 225. In one embodiment, the first surface 271 and the second surface 275 are generally circular and each forms an inner diameter and an outer diameter. Each of the inner diameters of the first surface 271 and the second surface 275 is sized to allow the drill string 155 to pass through the inner diameter of the first surface 271 and the second surface 275. The first surface 271 has at least a plurality of bores 280*a*, 280*b*, and 280*c* that are configured to couple to a plurality of bores (not shown) located on the locking plate 267 in FIG. 3. The second surface 275 has at least a plurality of bores 287*a*, 287*b*, and 287*c* that are configured to couple to the bell nipple section 210 in various embodiments.

In one embodiment, the bell nipple section 210 includes an upper nipple tubular member 285 and a lower nipple tubular member 290 that form a longitudinally telescoping pipe assembly. In one embodiment, the upper nipple tubular member 285 and the lower nipple assembly 290 are matching, and generally cylindrical, in shape and each forms an inner diameter and an outer diameter. In one embodiment, the upper nipple tubular member 285 defines an internal passage having a longitudinal axis. In one embodiment, the lower tubular member 290 defines another internal passage. The inner diameter of the upper nipple tubular member 285 and the inner diameter of the lower nipple assembly 290 are each sized to allow the drill string 155 to pass through the inner diameter of the upper nipple tubular member 285 and the inner diameter of the lower nipple tubular member 290. In one embodiment, the outer diameter of the upper nipple tubular member 285 is sized smaller than the inner diameter of the lower nipple tubular member 290 to allow for the upper nipple tubular member 285 to be disposed at least partially within the internal passage of the lower nipple tubular member 290. At least a plurality of bores 295*a*, 295*b*, and 295*c* are disposed on a locking plate 300 that is located on an upper portion of the upper nipple tubular member 285. In one embodiment, the plurality of bores 295*a*-295*c* correspond to the plurality of bores 287*a*-287*c* of the flex joint section 205, respectively, to couple the upper nipple tubular member 285 to the second surface 275 at a lower portion of the flex joint section 205. In one embodiment, locking bores 295*a*, 295*b*, 295*c* are disposed on the locking plate 300 and are configured to receive the locking bolt 269.

A slip joint 305 is disposed on an upper portion of the lower nipple assembly 290 in various embodiments. The slip joint 305 is configured to allow for movement of the upper nipple tubular member 285 within the internal passage of the lower nipple tubular member 290 along the axis 225. In one embodiment, the slip joint 305 is an air slip joint. In one embodiment, two or more slip joints are disposed on the upper portion of the lower nipple tubular member 290. In one embodiment, at least a plurality of padeyes 310*a* and 310*b* are disposed on the lower nipple tubular member 290. In one embodiment, a flange 315 is located on a lower portion of the lower nipple tubular member 290. In one embodiment, at least a plurality of bores 320*a* and 320*b* are located on the flange 315. The slip joint 305 or alternative seals (not shown) may be used to inhibit fluid leakage from the bell nipple section 210.

In one embodiment, the mounting section 213 includes an intermediate section 330 disposed between an upper flange 335 and a lower flange 340 that are spaced along the axis 225. At least a plurality of bores 345*a* and 345*b* are located on the upper flange 335 and are configured to couple to the plurality of bores 320*a* and 320*b*. In all instances depicting and discussing the plurality of bores in this disclosure, it should be understood that more or fewer may also be permitted in various embodiments. In one embodiment, the lower flange 340 is configured to couple to the blow out preventer 180 (FIG. 1). In various embodiments, the intermediate section 330 has a frusto-conical shape to account for different inner diameters of a lower nipple tubular member 290 and a blowout preventer 180 (FIG. 1). In one embodiment, the intermediate section 330 tapers inwardly along axis 225 from the lower nipple tubular member 290 to the blow out preventer 180.

Figure 3:
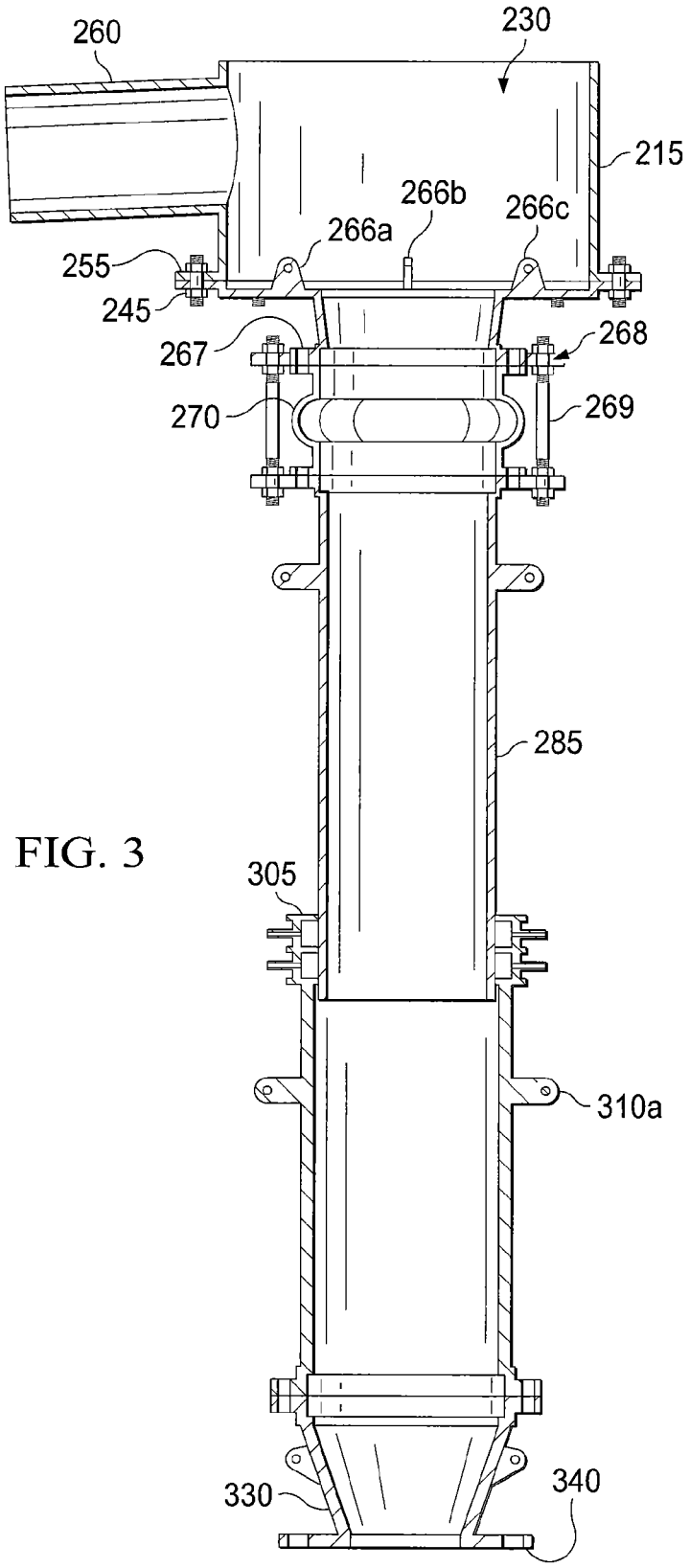
FIG. 3 is a side view of the bell nipple assembly of FIG. 1, according to one or more aspects of the present disclosure.

Referring to FIG. 3, the containment section 200 is configured to attach to the rig floor 110. In one embodiment, the containment section 200 forms a portion of the rig floor 110. In one embodiment, the drill string 155 and drilling fluid pass through the fluid flow passage 220. In one embodiment, the inner diameter of the upper containment housing portion 235 (FIG. 2) is larger than the inner diameter of the containment housing flange 245 so that the containment housing 215 may funnel the drill string 155 into the internal passage of the upper nipple tubular member 285. In one embodiment, the flow passage 220 allows the drilling fluid to exit the containment housing section 200 through the flow line 260 and flow towards drilling fluid equipment (not shown). In one embodiment, when the containment housing 215 and the containment housing flange 245 are coupled together using the plurality of bores 250*a*, 250*b*, 250*c* and the plurality of bores 265*a*, 265*b*, and 265*c*, a positive seal is created between the containment housing 215 and the containment housing flange 245. In one embodiment, coupling the containment housing 215 to the containment housing flange 245 encourages the drilling fluid to exit the containment housing section 200 through the flow passage 220 and out the flow line 260. That is, coupling the plurality of bores 250*a*, 250*b*, 250*c* to the plurality of bores 265*a*, 265*b*, and 265*c* minimizes or prevents unwanted environmental spills of the drilling fluid. In one embodiment, the plurality of padeyes 266*a*-266*d* are used to support the containment flange 245 during assembly of the bell nipple assembly 185. In one embodiment, cables strung through the plurality of padeyes 266*a*-266*d* are used to support the containment flange 245, and may be used to support any connected sections, during assembly of the bell nipple assembly 185.

In one embodiment, the flex joint section 205 is configured to couple the containment housing section 200 to the bell nipple section 210. In one embodiment, the first surface 271 is coupled to the containment housing section 200 using the plurality of bores 280*a*, 280*b* and 280*c* and the plurality of bores located on the locking plate 267 (not shown). In one embodiment the second surface 275 is coupled to the bell nipple section 210 using the plurality of bores 287*a*, 287*b*, and 287*c* on the second surface 275 and the plurality of bores 295*a*, 295*b*, and 295*c* disposed on the locking plate 300. In one embodiment, the longitudinal axis of the internal passage of the upper nipple tubular member 285 and a longitudinal axis of the containment housing section 200 are not coaxial (the axes are misaligned by an offset amount equaling the angle at which the axes intersect). In one embodiment, the misalignment between the longitudinal axes is due to an annular at the wellhead 180 being severed at an angle. That is, if the annular to which the blow out preventer 180 connects is not in a plane perpendicular to a longitudinal axis of the wellbore 160, then a longitudinal axis of the blow out preventer 180 will not be coaxial to the longitudinal axis of the wellbore 160. In other embodiments, the misalignment is due to a lateral offset of longitudinal axes of the upper nipple tubular member 285 and the containment housing section 200. When the upper nipple tubular member 285 is coupled to the blow out preventer 180, the misalignment between the longitudinal axes continues to the upper nipple tubular member 285. In one embodiment, the flex joint section 205 adjusts to accommodate the offset between the longitudinal axes. In one embodiment, the flex joint section 205 adjusts for the offset, which equals the angle at which the axes intersect. After the first surface 271 is coupled to the containment housing section 200 and the second surface 275 is coupled to the upper nipple tubular member 285, a plurality of locking bolts, including the locking bolt 269, secures the flex joint 270 using the locking bores 268 and locking bolts 269 to minimize or prevent damage to the flex joint 270. The flex joint 270 may be formed of a pliable or elastic material that may permit the first surface 271 and the second surface 275 to displace relative to one another. For example, the flex joint 270 may be formed of any known suitable pliable material, including, for example, elastomers, such as butyl, neoprene, nitrile, natural or synthetic rubbers, including chlorosulfonated polyethylene (CSPE) synthetic rubbers, fluoroelastomers, such as VITON, polymers, such as, polyurethane, silicone, silicone-polyurethane, and ethylene propylene diene monomers (EPDM), among many elastomeric or other types of materials, including combinations of materials. Other suitable pliable materials may include flexible metal materials, including without limitation, NITINOL or other superelastic alloys. Further, combinations of superelastic alloys and non-metal elastomeric materials also may be suitable. In some aspects, the materials for the flex joint may be commercially available from general products based on various factors related to a particular drilling environment, such as PH, temperature, and pressure, for example.

Figure 4:
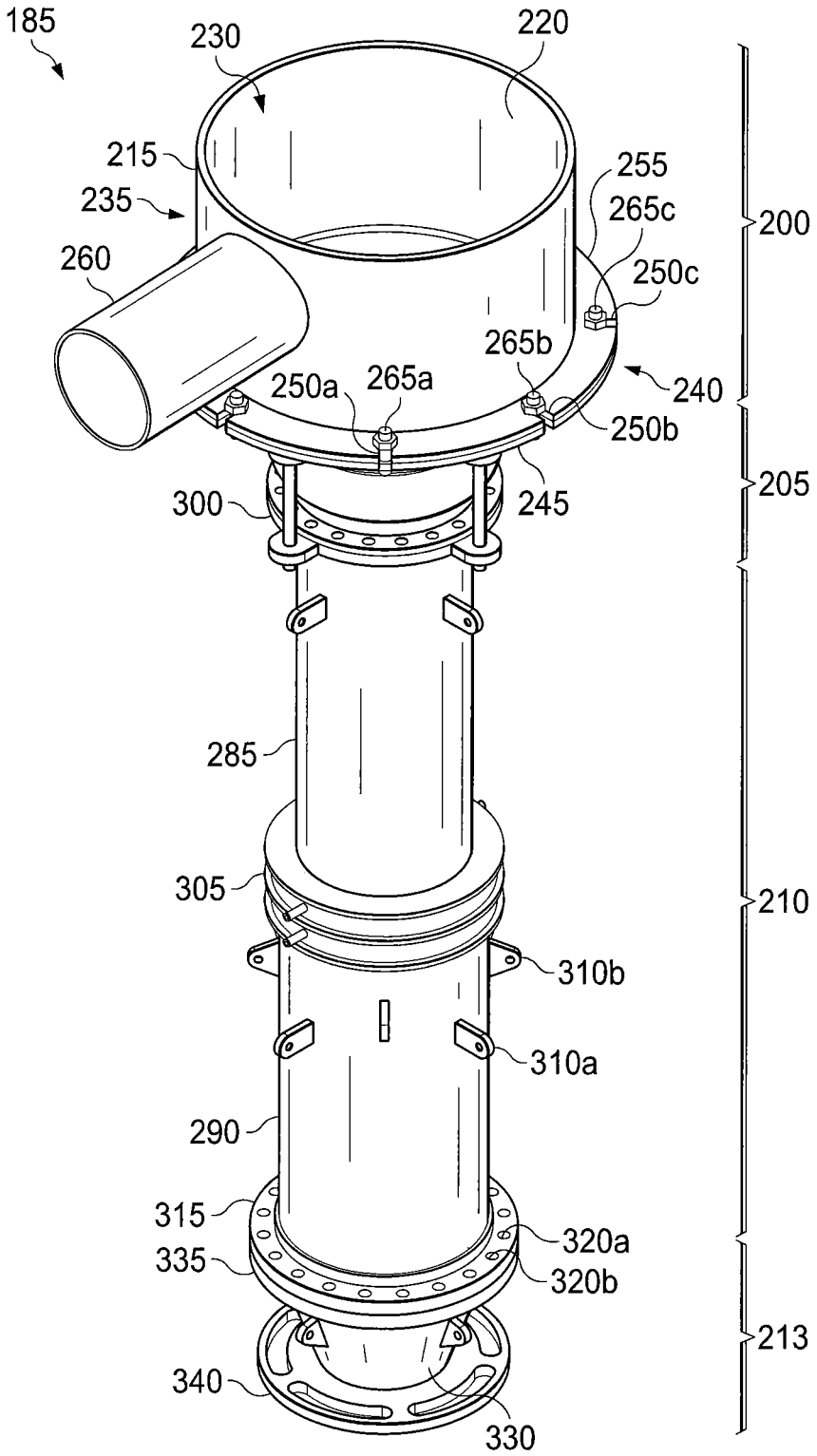
FIG. 4 is a perspective view of the bell nipple assembly of FIG. 1, according to one or more aspects of the present disclosure.
Figure 5:
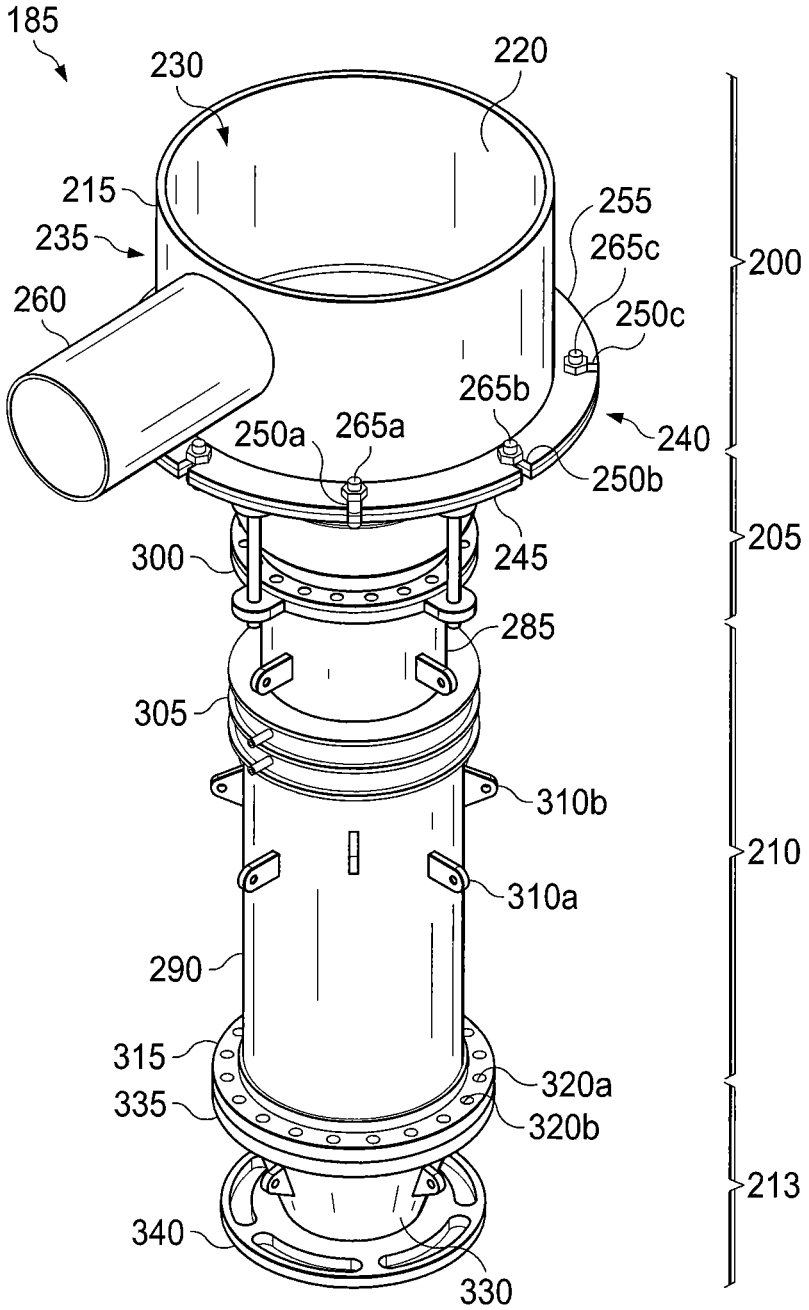
FIG. 5 is another perspective view of the bell nipple assembly of FIG. 1, according to one or more aspects of the present disclosure.

The telescopic nature of the bell nipple assembly is described in greater detail with reference to FIGS. 4 and 5. As shown, the bell nipple section 210 is configured to extend vertically along the axis 225. In one embodiment, the bell nipple section 210 has an extended position, as shown telescoped in FIG. 4, and a retracted position, as shown in FIG. 5. In one embodiment, the extended position is associated with a first length of the upper nipple tubular member 285 extending within the internal passage of the lower tubular member 290. In one embodiment, the retracted position is associated with a second length of the upper nipple tubular member 285 extending within the internal passage of the lower bell nipple assembly 290, the second length being greater than the first length. The bell nipple section 210 is configured to adjust the height (length measured along the axis 225) of the bell nipple assembly 185. In one embodiment, adjusting the height of the bell nipple assembly 185 allows for the bell nipple assembly 185 to be used with multiple types of blow out preventers, each type of blow out preventer having varying heights. In one embodiment, activation of the slip joint 305 secures the position of the bell nipple section 210. In one embodiment, activation of the slip joint 305 further minimizes or prevents drilling fluid from exiting the bell nipple assembly at the connection between the upper nipple tubular member 285 and the lower tubular member 290. In one embodiment, a cable may be strung through the plurality of padeyes 310*a* and 310*b* to support the lower tubular member 290 during position changes of the bell nipple section 210. That is, by supporting the lower tubular member 290 during position changes of the bell nipple section 210, at least a portion of the upper nipple tubular member 285 will remain extending within the internal passage of the lower bell nipple assembly 290. In one embodiment, the flange 320 is configured to couple to the mounting section 213 using the plurality of bores 320*a*, 320*b*, and 345*a* and 345*b* (FIG. 2).

In one embodiment, the mounting section 213 is connected to the bell nipple section 210 using the using the plurality of bores 320*a*, 320*b*, 345*a*, and 345*b* (FIG. 2) and coupled to the blow out preventer using the flange 340. In one embodiment, the bell nipple assembly 185 may include one of a plurality of mounting sections with each mounting section 213 associated with a blow out preventer diameter. In one embodiment, a mounting section 213 is selected to be attached to the bell nipple assembly 185 from the plurality of mounting sections 213 based on blow out preventer 180. That is, if the blow out preventer 180 has a diameter of 15 inches, a mounting section associated with a diameter of 15 inches can be selected and can be used to couple the blow out preventer 180 to the bell nipple section 210. In one embodiment, the ability to choose from a variety of mounting sections 213 allows the bell nipple assembly 185 to adapt to blow out preventers having a variety of sizes. This eliminates the need for frequent replacement of the bell nipple assembly 185 to another having a suitable diameter to match the blow out preventer 180 to which it will be associated in use.

In another embodiment, a plurality of slip joints 305 may be used, for example, adjacent to each other in a retracted position and separated in an extended position when telescoped, to ensure that the position of the bell nipple assembly 210 is secure.

In view of all of the above and the Figures, one of ordinary skill in the art will readily recognize that the present disclosure introduces an apparatus, that includes a bell nipple assembly having a first internal passage comprising: a first section forming a part of the first internal passage, the first section comprising a first end portion and a second end portion, the first end portion having a first longitudinal axis; and a flexible connector disposed between the first end portion and the second end portion. The bell nipple assembly also comprises a second section forming a part of the first internal passage, the second section comprising: a first tubular member having a second longitudinal axis; and a second tubular member, a length of the first tubular member telescopically extending within a portion of the second tubular member. The flexible connector is configured to at least partially adjust for an offset amount between the first longitudinal axis and the second longitudinal axis.

In an aspect, the bell nipple assembly further comprises: a containment housing forming a part of the first internal passage and having an upper portion and a lower portion, the upper portion configured to receive a drilling tool, drilling fluid, or both; a containment flange about the first internal passage and configured to couple the lower portion of the containment housing to the first end portion; and a flowline fluidically coupled to the containment housing; wherein coupling the containment flange to the containment housing forms a seal therebetween. In an aspect, the first internal passage is configured to receive a drilling fluid and wherein the seal minimizes or prevents the passage of fluids between the containment flange and the containment housing. In an aspect, the second tubular member has a second tubular member diameter, wherein the bell nipple assembly further comprises a third section forming a part of the first internal passage and configured to couple to the second tubular member, the third section having an upper third section diameter and a lower third section diameter; wherein the upper third section diameter is associated with the second tubular member diameter; and wherein the lower third section diameter is associated with a diameter of an annular. In an aspect, the annular is associated with a blow out preventer. In an aspect, the upper third section diameter and the lower third section diameter differ. In an aspect, the third section comprises a frusto-conical shape that tapers inwardly from the upper third section diameter to the lower third section diameter. In an aspect, the first section is configured to couple to a rig floor. In an aspect, the flexible connector is a flex joint. In an aspect, the flexible connector entirely adjusts for the offset amount so that the first longitudinal axis is vertical.

In an aspect, the disclosure also introduces a method of adjusting for axial offset in a drilling rig, comprising: providing a first section, a second section, and a flexible connection zone forming a part of a first internal passage below a drilling rig floor, the flexible connection zone being disposed between the first and second sections, the first section having a first longitudinal axis and the second section having a second longitudinal axis; and providing a telescoping section forming a part of the first internal passage, the telescoping section comprising: a first tubular member having a second longitudinal axis; and a second tubular member, a length of the first tubular member telescopically extending within a portion of the second tubular member, wherein the flexible connection zone at least partially adjusts for an offset amount between the first longitudinal axis and the second longitudinal axis.

In one embodiment, the offset amount is an angle less than about 10 degrees. In varying embodiments, the offset amount is an angle less than about: 8 degrees, 6 degrees, 4 degrees, or 2 degrees. In another embodiment, the flexible connection zone includes a flexible connector that seals between the first and second sections to minimize or prevent passage of a fluid therebetween. In a further embodiment, the connecting section is operably connected between the section at an upper end and a blow out preventer at a lower end.

In a third aspect, the disclosure encompasses a method that includes providing a bell nipple zone that adjusts an offset amount and defines a first internal passage that includes: providing a first section forming the first internal passage, wherein the first section has a flexible connector disposed between a first flange and a second flange; wherein the first flange is associated with a first longitudinal axis; and providing a second section including: a first tubular member defining a second internal passage having a second longitudinal axis; the second longitudinal axis misaligned from the first longitudinal axis by an offset amount; and a second tubular member defining a third internal passage, a length of the first tubular member extending within a portion of the third internal passage; wherein the second internal passage and the third internal passage form a lower portion of the first internal passage; wherein the bell nipple zone has a height measured along the first longitudinal axis; wherein changing the distance by which the first tubular extends within the third internal passage changes the height of the bell nipple zone; and wherein the flexible connector at least partially adjusts for the offset amount between the first longitudinal axis and the second longitudinal axis.

In one embodiment, the method further includes providing the bell nipple zone with: a containment housing zone forming the first internal passage and having an upper portion and a lower portion, the upper portion configured to receive a drilling tool, drilling fluid, or both; a containment flange about the first internal passage and configured to couple the lower portion of the containment housing zone to the flexible connector; and a flowline fluidically coupled to the containment housing zone; wherein coupling the containment flange to the containment housing zone forms a seal therebetween. In another embodiment, the method includes configuring the first internal passage to receive a drilling fluid and the seal to minimize or prevent the passage of fluids between the containment flange and the containment housing. In a further embodiment, the second tubular member is provided with a second tubular member diameter, and the method further includes providing to the bell nipple zone a third section forming a part of the first internal passage and configured to couple to the second tubular member, the third section having an upper third section diameter and a lower third section diameter; wherein the upper third section diameter is associated with the second tubular member diameter; and wherein the lower third section diameter is associated with a diameter of an annular.

In another embodiment, the method includes associating the annular with a blow out preventer. In a further embodiment, the upper third section diameter and the lower third section diameter differ. In yet another embodiment, the third section is provided a frusto-conical shape that tapers inwardly from the upper third section diameter to the lower third section diameter.

In various embodiments, the first section is configured to couple to a rig floor. In various embodiments, the flexible connector is selected to include a flex joint. In yet another embodiment, the flexible connector adjusts entirely for the offset amount so that the first longitudinal axis is vertical.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. §112(f) for any limitations of any of the claims herein, except for those in which the claim expressly uses the word "means" together with an associated function.

What is claimed is:

1. An apparatus, comprising:

a bell nipple assembly having an internal passage, the assembly comprising:

a containment housing that has a first longitudinal axis;

a containment flange coupled to the containment housing to create a seal between the containment flange and the containment housing;

a first tubular member having a second longitudinal axis;

a second tubular member, a length of the first tubular member telescopically extending within a portion of the second tubular member, a slip joint structurally configured to secure the first tubular member in a first vertical position relative to the second tubular member; and a flexible connector disposed between, and coupled to, each of the containment flange and the first tubular member to at least partially accommodate an offset amount between the first longitudinal axis and the second longitudinal axis;

wherein each of the containment housing, the containment flange, the first tubular member, the second tubular member, and the flexible connector forms a portion of the internal passage.

2. The apparatus of claim 1, wherein the containment housing has an upper portion and a lower portion, the upper portion configured to receive a drilling tool, a drilling fluid, or both;

wherein the containment flange is configured to couple the lower portion of the containment housing to the flexible connector; and wherein the bell nipple assembly further comprises a flowline fluidically coupled to the containment housing.

3. The apparatus of claim 2, wherein the internal passage is configured to receive the drilling fluid and wherein the seal between the containment housing and the containment flange minimizes or prevents the passage of the drilling fluid between the containment flange and the containment housing.

4. The apparatus of claim 1, wherein the second tubular member has a second tubular member diameter, wherein the bell nipple assembly further comprises a third tubular member having:

an upper end portion that couples to an end portion of the second tubular member to form a seal therebetween; and a lower end portion that is structurally configured to couple to end portion of a blow out preventer in a manner such that the lower end portion of the third tubular member is positionable between the upper end portion of the third tubular member and the end portion of the blow out preventer;

wherein the upper end portion of the third tubular member has a diameter and the lower end portion of the third tubular member has a diameter;

wherein the diameter of the upper end portion of the third tubular member is associated with the second tubular member diameter; and wherein the diameter of the lower end portion of the third tubular member is associated with a diameter of the blow out preventer.

5. The apparatus of claim 4, wherein the diameter of the upper end portion of the third tubular member and the diameter of the lower end portion of the third tubular member differ.

6. The apparatus of claim 4, wherein the third tubular member comprises a frusto-conical shape that tapers inwardly from the upper end portion to the lower end portion.

7. The apparatus of claim 1, wherein the containment housing is configured to couple to a rig floor.

8. The apparatus of claim 1, wherein the flexible connector is a flex joint.

9. The apparatus of claim 1, wherein each of the containment flange and the first tubular member is structurally configured to accommodate a plurality of bolts to secure the containment flange relative to the first tubular member.

10. A method of adjusting for axial offset in a drilling rig, comprising:

providing a first section, a second section, and a flexible connection zone forming a part of a first internal passage below a drilling rig floor, the flexible connection zone being disposed between the first and second sections, the first section having a first longitudinal axis and the second section having a second longitudinal axis;

providing a telescoping section forming a part of the first internal passage, the telescoping section comprising:

a first tubular member having the second longitudinal axis; and a second tubular member, a length of the first tubular member telescopically extending within a portion of the second tubular member, and activating a slip joint to secure the first tubular member in a first vertical position relative to the second tubular member;

wherein the flexible connection zone at least partially adjusts for an offset amount between the first longitudinal axis and the second longitudinal axis.

11. The method of claim 10, wherein the offset amount is an angle less than about 10 degrees.

12. The method of claim 10, wherein the flexible connection zone comprises a flexible connector that seals between the first and second sections to minimize or prevent leakage of fluid therebetween.

13. The method of claim 10, the method further comprising:

coupling an upper end portion of a third tubular member to an end portion of the second tubular member to form a seal therebetween; and coupling a lower end portion of a third tubular member to an end portion of a blow out preventer such that the lower end portion of the third tubular member is positioned between the upper end portion of the third tubular member and the end portion of the blow out preventer.

14. The method of claim 10, further comprising securing the first section relative to the second section.

15. A method comprising:

coupling a containment housing to a containment flange to create a seal that minimizes or prevents the passage of fluids between the containment flange and the containment housing;

wherein the containment housing has a first longitudinal axis;

providing:

a first tubular member having a second longitudinal axis that is different from the first longitudinal axis by an offset amount; and a second tubular member, a length of the first tubular member telescopically extending within a portion of the second tubular member;

coupling, using a flexible connector, the containment housing and the first tubular member;

wherein a bell nipple assembly that comprises the containment housing, the containment flange, the first tubular member, the second tubular member, and the flexible connector has a height measured along the first longitudinal axis; and wherein changing the distance by which the first tubular extends within the second tubular member changes the height of the bell nipple assembly; and securing the first tubular relative to the second tubular member to fix the height of the bell nipple assembly;

wherein each of the containment housing, the containment flange, the first tubular member, the second tubular member, and the flexible connector forms a portion of an internal passage; and wherein the flexible connector at least partially adjusts for the offset amount between the first longitudinal axis and the second longitudinal axis.

16. The method of claim 15, wherein the containment housing has an upper portion and a lower portion, the upper portion configured to receive a drilling tool, a drilling fluid, or both;

wherein the containment flange is configured to couple the lower portion of the containment housing zone to the flexible connector; and wherein the method further comprises fluidically coupling a flowline to the containment housing.

17. The method of claim 15, further comprising:

coupling an upper end portion of a third tubular member to an end portion of the second tubular member to form a seal therebetween; and coupling a lower end portion of the third tubular member to an end portion of a blow out preventer such that the lower end portion of the third tubular member is positioned between the upper end portion of the third tubular member and the end portion of the blow out preventer;

wherein the second tubular member is provided with a second tubular member diameter, wherein the upper end portion of the third tubular member has a diameter and the lower end portion of the third tubular member has a diameter;

wherein the diameter of the upper end portion of the third tubular member is associated with the second tubular member diameter; and wherein the diameter of the lower end portion of the third tubular member is associated with a diameter of the blow out preventer.

18. The method of claim 17, wherein the diameter of the upper end portion of the third tubular member and the diameter of the lower end portion of the third tubular member differ.

19. The method of claim 17, wherein the third tubular member comprises a frusto-conical shape that tapers inwardly from the upper end portion to the lower end portion.

20. The method of claim 15, wherein the containment housing is configured to couple to a rig floor.

21. The method of claim 15, wherein the flexible connector is selected to comprise a flex joint.

22. The method of claim 15, further comprising securing the containment housing relative to the first tubular member.

* * * * *